US010669832B2

(12) United States Patent
Dawson et al.

(10) Patent No.: US 10,669,832 B2
(45) **Date of Patent: *Jun. 2, 2020**

(54) WELL SYSTEM OF ACQUIRING INFORMATION OF HYDRAULIC FRACTURE GEOMETRY FOR EVALUATING AND OPTIMIZING WELL SPACING FOR MULTI-WELL PAD

(71) Applicant: STATOIL GULF SERVICES LLC, Houston, TX (US)

(72) Inventors: Matthew A. Dawson, Houston, TX (US); Günther Kampfer, Houston, TX (US)

(73) Assignee: STATOIL GULF SERVICES LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,301

(22) Filed: Jul. 3, 2018

(65) Prior Publication Data

US 2018/0320499 A1 Nov. 8, 2018

Related U.S. Application Data

(63) Continuation of application No. 14/618,865, filed on Feb. 10, 2015, now Pat. No. 10,030,497.

(51) Int. Cl.
*E21B 43/30* (2006.01)
*E21B 43/26* (2006.01)
(Continued)

(52) U.S. Cl.
CPC ..... *E21B 43/30* (2013.01); *E21B 43/126* (2013.01); *E21B 43/17* (2013.01); *E21B 47/06* (2013.01)

(58) Field of Classification Search
CPC ..... E21B 43/26; E21B 47/06
See application file for complete search history.

(56) References Cited

U.S. PATENT DOCUMENTS 3,586,105 A 6/1971 Johnson et al.
6,268,911 B1 7/2001 Tubel et al.
(Continued)

FOREIGN PATENT DOCUMENTS

GB 2379685 A 3/2003
WO 2013/008195 A2 1/2013
(Continued)

OTHER PUBLICATIONS

Ali Daneshy, Fracture Shadowing: A Direct method of determining of the reach and propagation pattern of hydraulic fractures in horizontal wells, Feb. 6-8, 2012, SPE 151980, The Woodlands Texas, US.

(Continued)

*Primary Examiner* — Robert E Fuller
(74) *Attorney, Agent, or Firm* — Birch, Stewart, Kolasch & Birch, LLP

(57) ABSTRACT

A method for optimizing well spacing for a multi-well pad which includes a first group of wells and a second group of wells is provided. The method includes the steps of: creating a fracture in a stage in a first well in the first group of wells; isolating a next stage in said first well in the first group of wells from said stage; creating a fracture in said next stage in the first well in the first group after the step of isolating; measuring a pressure by using a pressure gauge in direct fluid communication with said next stage in the first well in the first group of wells; creating a fracture in one or more stages in a well in the second group of wells in a manner such that the fracture in the well in the second group of wells induces the pressure measured in the first well to change;

(Continued)

and recording the pressure change in the next stage of the first well.

18 Claims, 5 Drawing Sheets

(51) Int. Cl.

| | |
|---|---|
| ***E21B 47/06*** | (2012.01) |
| ***E21B 43/17*** | (2006.01) |
| ***E21B 43/12*** | (2006.01) |

(56) References Cited

U.S. PATENT DOCUMENTS

| | | | |
|---|---|---|---|
| 6,281,489 | B1 | 8/2001 | Tubel et al. |
| 6,302,204 | B1 | 10/2001 | Reimers et al. |
| 6,531,694 | B2 | 3/2003 | Tubel et al. |
| 6,588,266 | B2 | 7/2003 | Tubel et al. |
| 6,787,758 | B2 | 9/2004 | Tubel et al. |
| 6,828,547 | B2 | 12/2004 | Tubel et al. |
| 7,028,772 | B2 | 4/2006 | Wright et al. |
| 7,040,390 | B2 | 5/2006 | Tubel et al. |
| 7,201,221 | B2 | 4/2007 | Tubel et al. |
| 7,397,388 | B2 | 7/2008 | Huang et al. |
| 7,819,181 | B2 | 10/2010 | Entov et al. |
| 8,061,427 | B2 | 11/2011 | Jackson et al. |
| 8,204,727 | B2 | 6/2012 | Dean et al. |
| 8,511,384 | B2 | 8/2013 | Valdez |
| 8,789,587 | B2 | 7/2014 | Tubel et al. |
| 8,807,222 | B2 | 8/2014 | Jeronimo |
| 9,164,192 | B2 | 10/2015 | Maerten et al. |
| 2002/0066309 | A1 | 6/2002 | Tubel et al. |
| 2003/0205083 | A1 | 11/2003 | Tubel et al. |
| 2004/0043501 | A1 | 3/2004 | Means et al. |
| 2006/0102342 | A1 | 5/2006 | East et al. |
| 2008/0087420 | A1 | 4/2008 | Kaminsky et al. |
| 2009/0194273 | A1 | 8/2009 | Surjaatmadja |
| 2011/0067857 | A1 | 3/2011 | Underhill et al. |
| 2011/0264373 | A1 | 10/2011 | Hehmeyer et al. |
| 2013/0191044 | A1 | 7/2013 | Maerten et al. |
| 2013/0298665 | A1 | 11/2013 | Minchau |
| 2014/0166280 | A1 | 6/2014 | Stone et al. |
| 2014/0288840 | A1 | 9/2014 | Vermilye et al. |
| 2015/0055438 | A1 | 2/2015 | Yan et al. |
| 2015/0075775 | A1 | 3/2015 | Davidson et al. |
| 2015/0075777 | A1 | 3/2015 | Walters et al. |
| 2015/0075778 | A1 | 3/2015 | Walters et al. |
| 2015/0075779 | A1 | 3/2015 | Walters et al. |
| 2015/0083405 | A1 | 3/2015 | Dobroskok et al. |
| 2015/0176394 | A1 | 6/2015 | Roussel et al. |
| 2015/0211347 | A1 | 7/2015 | Snider et al. |
| 2016/0003020 | A1 | 1/2016 | Sharma |
| 2016/0047215 | A1 | 2/2016 | Soliman et al. |
| 2016/0333684 | A1 | 11/2016 | James et al. |

FOREIGN PATENT DOCUMENTS

| | | | |
|---|---|---|---|
| WO | 2014/058745 | A2 | 4/2014 |
| WO | 2014/121270 | A2 | 8/2014 |

OTHER PUBLICATIONS

Christopher Sardinha, Determining Interwell Connectivity and Reservoir Complexity Through Frac Pressure hits and Production Interference Analysis, Sep. 30-Oct. 2, 2014, Calgary, Alberta, Canada, SPE 171628.

Escobar et al., "Rate-Transient Analysis for Hydraulically Fractured Vertical Oil and Gas Wells," ARPN Journal of Engineering and Applied Science, vol. 9, No. 5, May 2014, pp. 739-749.

Nolte, "Determination of Fracture Parameters from Fracturing Pressure Decline," Society of Petroleum Engineers of AIME, SPE 8341, 1979, pp. 1-11 (16 pages total).

WELL SYSTEM OF ACQUIRING INFORMATION OF HYDRAULIC FRACTURE GEOMETRY FOR EVALUATING AND OPTIMIZING WELL SPACING FOR MULTI-WELL PAD

CROSS-REFERENCE TO RELATED APPLICATION

This application is a continuation of, and claims priority under 35 U.S.C. § 120 to, U.S. patent application Ser. No. 14/618,865, filed on Feb. 10, 2015, and entitled "WELL SYSTEM OF ACQUIRING INFORMATION OF HYDRAULIC FRACTURE GEOMETRY FOR EVALUATING AND OPTIMIZING WELL SPACING FOR MULTI-WELL PAD," the entire contents of which are incorporated by reference herein.

BACKGROUND OF THE INVENTION

1. Field of the Invention

The present invention relates to reservoir technology, and more particularly to a method of acquiring information of hydraulic fracture geometry for evaluating and optimizing well spacing for a multi-well pad.

2. Description of Background Art

Over the years, the research on reservoir technology focuses on maximizing the value of ultra-tight resources, sometimes referred to as shales or unconventionals resources. Ultra-tight resources, such as the Bakken, have very low permeability compared to conventional resources. They are often stimulated using hydraulic fracturing techniques to enhance production and often employ ultra-long horizontal wells to commercialize the resource. However, even with these technological enhancements, these resources can be economically marginal and often only recover 5-15% of the original oil in place under primary depletion. Therefore, optimizing the development of these ultra-tight resources by optimizing the well spacing and completions is critical.

In conventional oil fields, there are many methods used for attempting to optimize well spacing. One of the most common methods is downspacing tests, where varying well spacings are chosen for different pads and production is compared at different spacings to assess which spacing is optimal. This technique is expensive and time consuming and often gives a highly uncertain answer, requiring this procedure to be repeated many times to increase accuracy in the result. This procedure, which often ends up with under drilling and over drilling numerous pads, can significantly reduce the value of the resource due to inefficient development. Another technique which has been widely adopted is to use subsurface or surface micro-seismic arrays to monitor seismic events during the hydraulic fracturing process. Ideally, this would provide insight into the dimensions of hydraulic fractures, helping to determine the optimal well spacing. However, this technology is often questionable for a number of reasons. First, and foremost, it is often accepted that microseismic predominantly identifies shear events, which may or may not be associated with the growth of hydraulic fractures. A second challenge with microseismic is that it requires knowledge of the subsurface, particularly wave velocities in the media, which are often unknown and have high uncertainty. Finally, the processing methods themselves are often brought into question, as many service companies who provide this technique use veiled algorithms and openly admit the uncertainty in these processing methods. Despite all these uncertainties and the significant cost of running microseismic, the value of understanding well spacing is so great that this technique has been widely applied in industry. Further, there are newer approaches under development which utilize advanced proppants or advanced imaging and data acquisition techniques. However, these approaches are still in the research stage and will likely be quite costly and potentially complex even if they are commercialized.

Another technology which has been used to evaluate well spacing is pressure measurements. This technology has been done downhole and at the surface. Tests have been performed during production, during shut-ins, and during hydraulic fracturing. For ultra-tight systems, tests during production are rarely done, even though that is the most commonly employed method for conventional systems to evaluate reservoir performance or fracture geometry. The shut-in times and data acquisition times for unconventional resources are often too long to justify these tests. Downhole gauges can be extremely expensive, particularly when placed anywhere along the lateral of a horizontal, costing sometimes in excess of 1 million dollars per gauge, particularly in unconventional resources, which are often deep formations, sometimes greater than 10,000 ft in depth. In addition, retrievable downhole gauges have been used, but again these gauges only measure pressure at one location in the well and can be quite costly to install and retrieve. Moreover, they cannot be used during the hydraulic fracturing process very easily, although some newer technologies are coming out to solve this problem. Because of the cost limitations of any method of measuring downhole pressures, the industry is slowly recognizing that surface gauges can be useful during the hydraulic fracturing process since there is a single, known, stable phase in the wellbore, allowing for surface gauges to act as surrogates for downhole gauges during the hydraulic fracturing process. Several tests have been done where surface gauges have been used during hydraulic fracturing. However, these tests do not involving isolating portions of wells off and thus the surface gauges are only measuring the response in the entire well of hydraulic fracturing operations in adjacent wells.

To date, no methods for evaluating hydraulic fracture geometry and optimizing the well spacing with less cost, more accurate results, and much fewer wells and inefficiently developed pads compared with the above mentioned conventional methods, have been successfully deployed in ultra-tight oil resources. Therefore, there is an industry-wide need for a method for evaluating hydraulic fracture geometry and optimizing well spacing for a multi-well pad in order to better understand optimal well spacing, so as to maximize the value of ultra-tight resources with less cost and higher certainty.

SUMMARY OF THE INVENTION

Accordingly, it is an object of the present invention to provide a method of acquiring information of hydraulic fracture geometry for optimizing well spacing for a multi-well pad and a method of optimizing well spacing using such information, which can avoid under drilling or over drilling numerous pads, reduce cost, and increase the certainty of results.

To achieve the above-mentioned object, according to a first aspect of the present invention, a method for acquiring information of hydraulic fracture geometry for optimizing well spacing for a multi-well pad which includes a first group of wells and a second group of wells is provided. The method comprises the steps of: (a) creating a fracture in a stage in a first well in the first group of wells; (b) isolating a next stage in said first well in the first group of wells from said stage; (c) creating a fracture in said next stage in the first well in the first group of wells after the step of isolating; (d) measuring a pressure by using a pressure gauge in direct fluid communication with said next stage in the first well in the first group of wells; (e) creating a fracture in one or more stages in a well in the second group of wells in a manner such that the fracture in the well in the second group of wells induces the pressure measured in the first well to change; and (f) recording the pressure change in the next stage in the first well. According to a second aspect of the present invention, a method of optimizing well spacing for a multi-well pad which includes a first group of wells and a second group of wells is provided. The method comprises the steps of the method for acquiring information of hydraulic fracture geometry for optimizing well spacing according to the first aspect of the present invention. The method further comprises the steps of processing the measured pressure change using a computer algorithm to obtain information related to the geometry of the fractures emanating from said next stage in the first well in the first group of wells and any stages in said well in the second group of wells; and evaluating communication between the first well in the first group of wells and the well in the second group of wells using said information.

The present invention offers significant advantages in the field of reservoir technology for evaluating hydraulic fracture geometry and optimizing well spacing for a multi-well pad, such as costing a mere fraction of alternative approaches (often 3 to 5 or more orders of magnitude less), requiring much fewer wells and much fewer inefficiently developed pads than the conventional approach of well spacing testing with variable spacings on a pad, and also requiring far less money and giving a more certain result than existing technologies such as microseismic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to one of ordinary skill in the art from this detailed description.

BRIEF DESCRIPTION OF THE DRAWINGS

The present invention will become more fully understood from the detailed description given below and the accompanying drawings that are given by way of illustration only and are thus not limitative of the present invention.

DETAILED DESCRIPTION OF THE INVENTION

Figure 1:
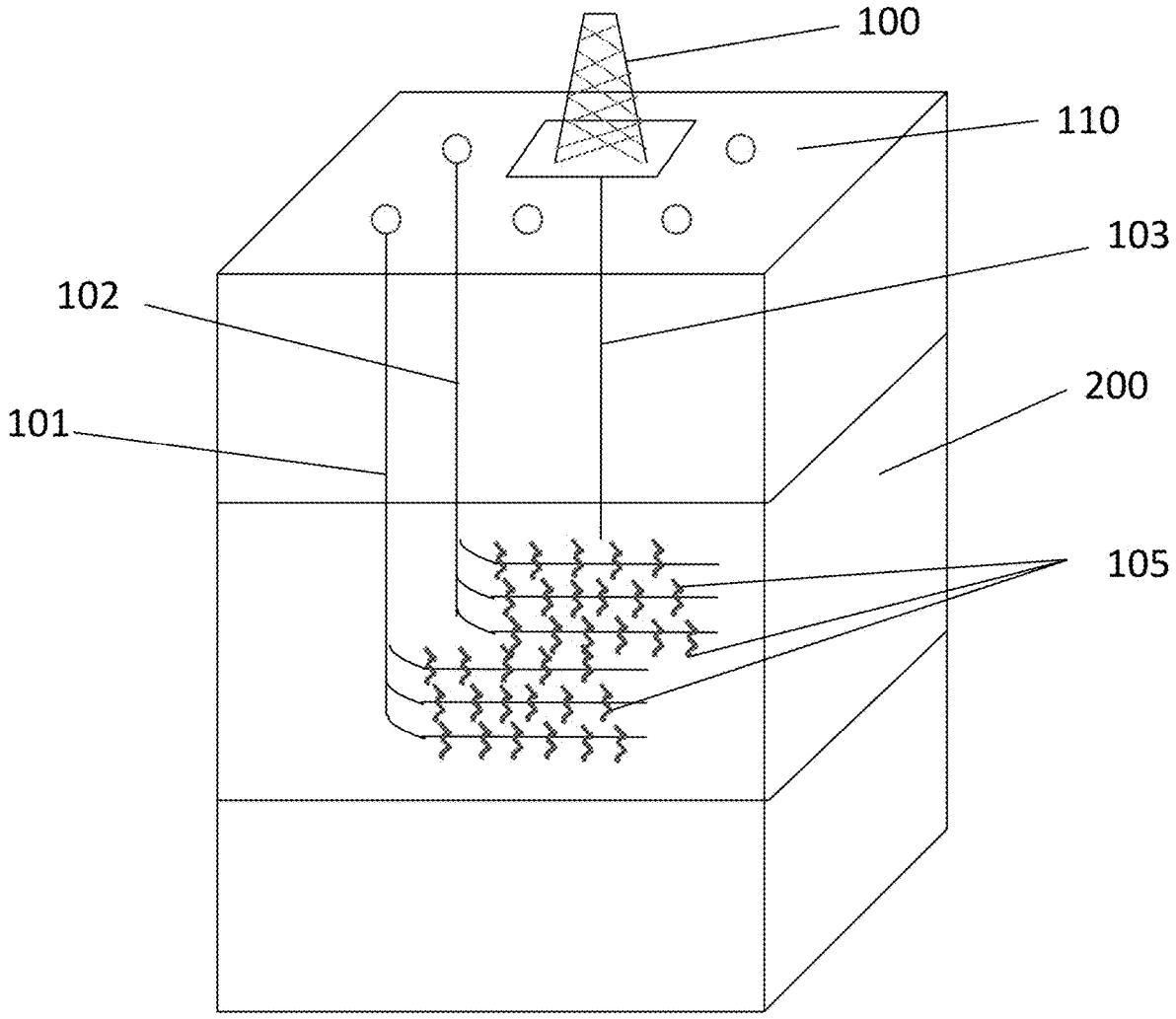
FIG. 1 is exemplary diagram of a drilling operation on a multi-well pad.

The present invention will now be described in detail with reference to the accompanying drawings, wherein the same reference numerals will be used to identify the same or similar elements throughout the several views. It should be noted that the drawings should be viewed in the direction of orientation of the reference numerals.

The present invention is directed to design the stage sequencing of a multi-well hydraulic fracturing job and design a pressure measurement technique during stimulation to acquire data that can be interpreted and analyzed for evaluating hydraulic fracture geometry, connectivity, and proximity and optimizing well spacing.

FIG. 1 shows an exemplary diagram of a drilling operation on a multi-well pad. One of ordinary skill in the art will appreciate that the drilling operation shown in FIG. 1 is provided for exemplary purposes only, and accordingly should not be construed as limiting the scope of the present invention. For example, the number of groups of wells and the number of wells in each group are not limited to those shown in FIG. 1. It is also noted that the wells may be conventional vertical wells without horizontal sections while horizontal wells that can increase production are depicted for exemplary purposes only.

As depicted in FIG. 1, the operation environment may suitably comprise several groups of wells 101, 102, 103 drilled by a drilling rig 100 from a single pad 110. The wells have vertical sections extending to penetrate the earth until reaching an oil bearing subterranean formation 200, and horizontal sections extending horizontally in the oil bearing subterranean formation 200 in order to maximize the efficiency of oil recovery. The formation can be hydraulically stimulated using conventional hydraulic fracturing methods, thereby creating fractures 105 in the formation. It is noted that while FIG. 1 illustrates that the several groups of wells 101, 102, 103 reach the same oil bearing subterranean formation 200, this is provided for exemplary purposes only, and in one or more embodiments of the present invention, the groups and the wells in different groups can be in different formations, for example, two different formations, Three Forks formation and Middle Bakken formation. According to an embodiment of the present invention, a method has been developed for evaluating hydraulic fracture geometry and optimizing well spacing for a multi-well pad by sequencing hydraulic fracturing jobs for the multi-well pad and isolating a single stage in a monitor well, while monitoring the pressure in said monitor well before and after stages in adjacent wells are hydraulically fractured, so that highly valuable data can be acquired for interpreting and analyzing to evaluate hydraulic fracture geometry, proximity, and connectivity.

Figure 2:
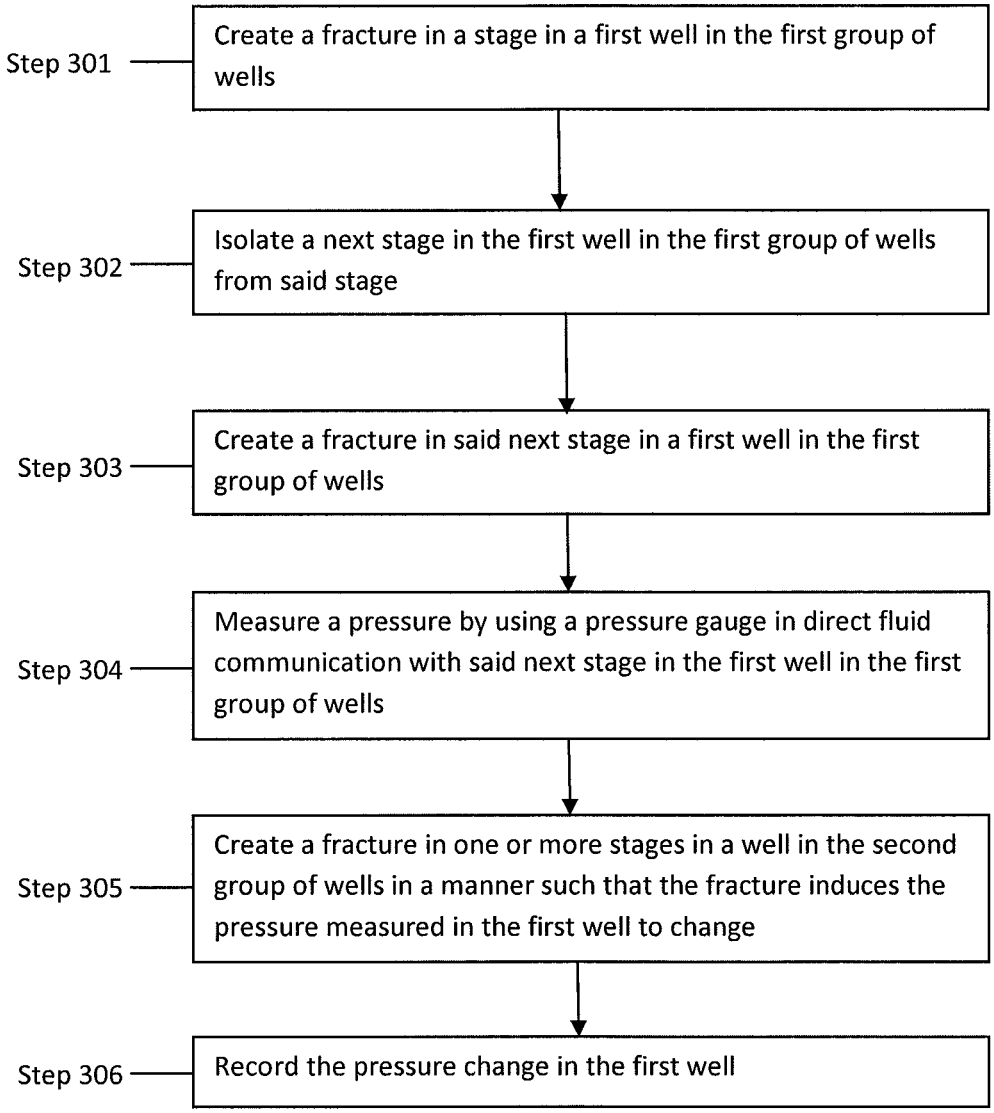
FIG. 2 is a flowchart in accordance with one embodiment of the present invention.
Figure 3A:
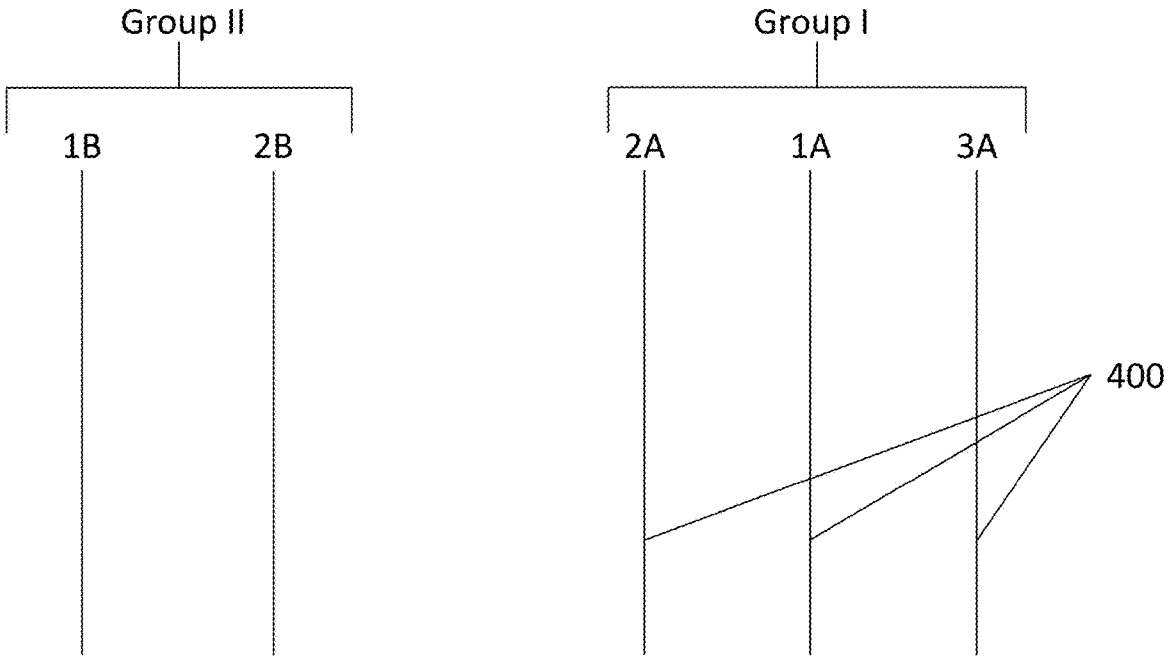
FIGS. 3(*a*)-3(*f*) are exemplary diagrams of the stage sequencing of a hydraulic fracturing operation for a multi-well pad according to the present invention.
Figure 3B:
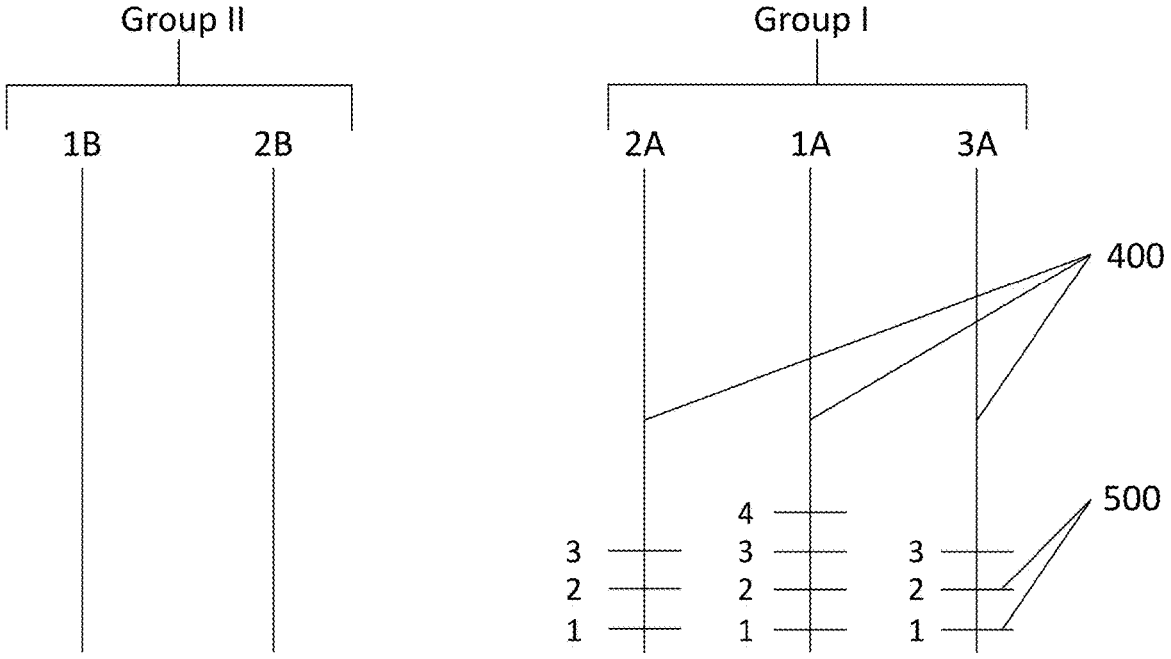
Figure 3C:
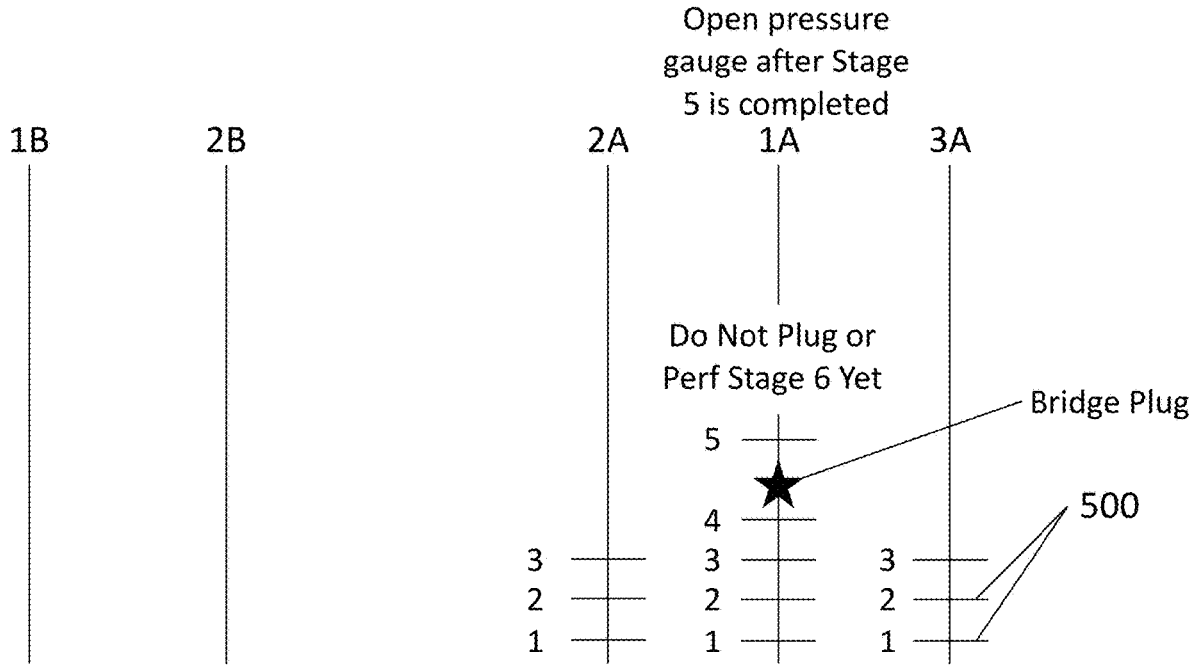
Figure 3D:
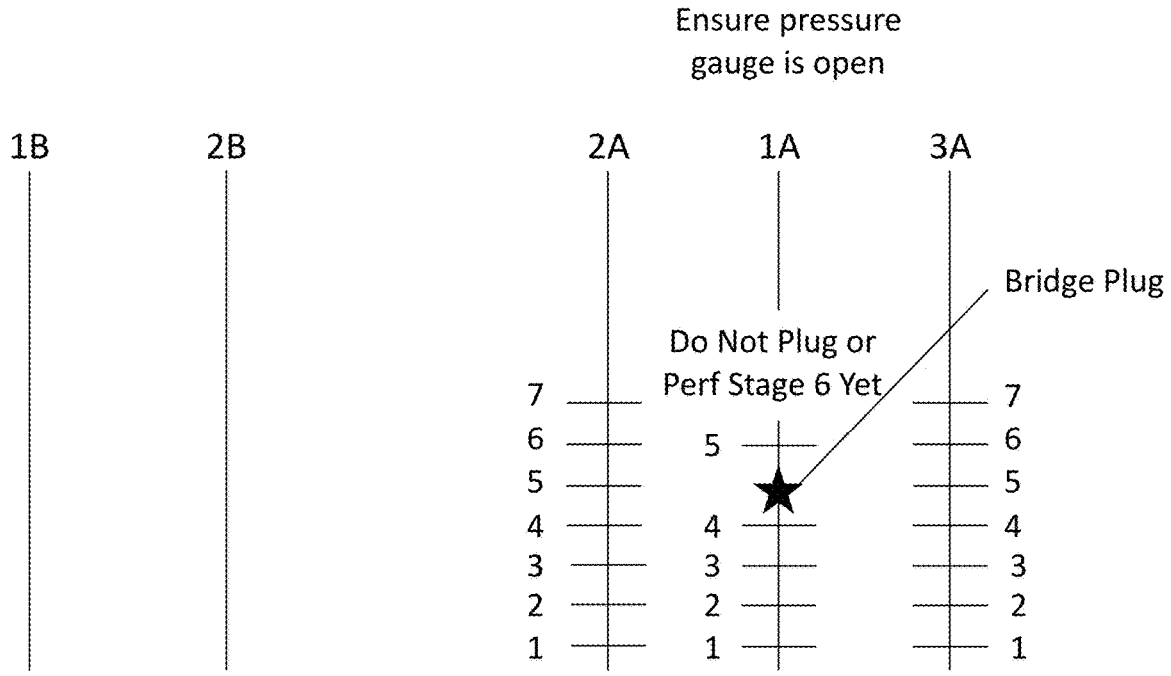
Figure 3E:
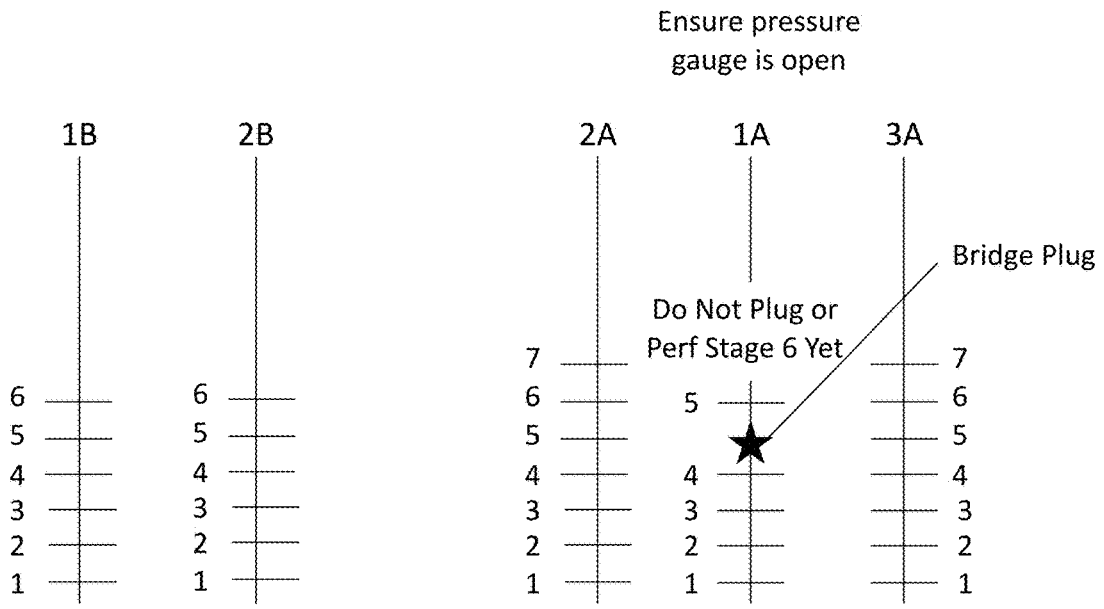
Figure 3F:
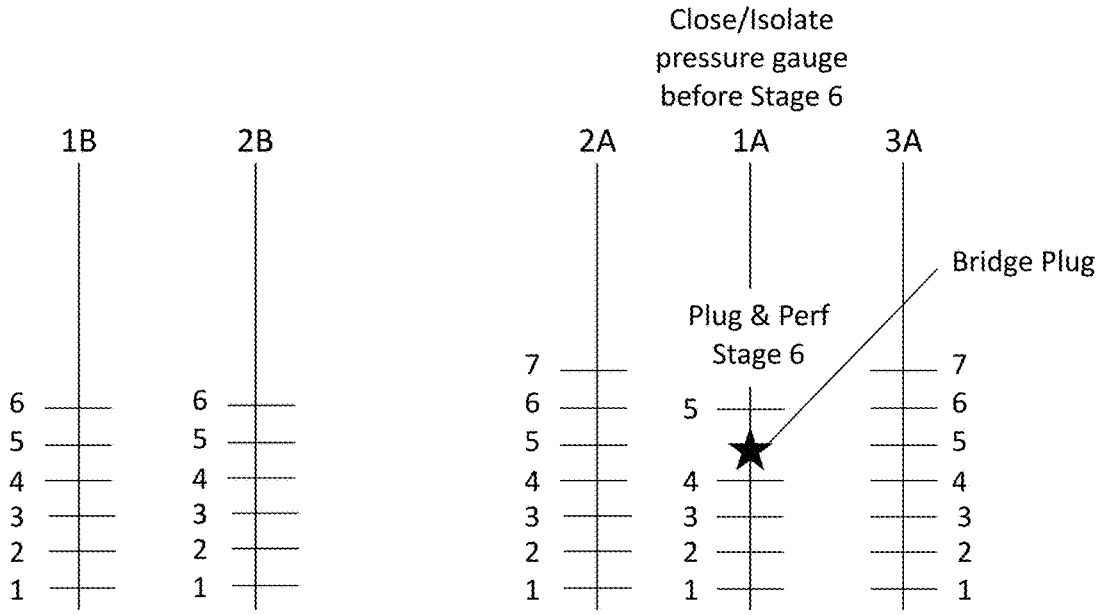

FIG. 2 is a flowchart in accordance with one embodiment of the present invention. Specifically, FIG. 2 is a flowchart of a method acquiring information of hydraulic fracture geometry for optimizing well spacing for a multi-well pad, which includes a first group of wells and a second group of wells in accordance with one embodiment of the present invention. In this embodiment, each of the first group and the second group include two or more wells. No well in the first group is common with the second group. However, in one or more embodiments of the present invention, each of the first group and the second group may include one or more wells, and some wells in the first group may be common with the second group.

In one embodiment of the present invention, a single multi-well pad includes at least a first group of wells and a second group of wells. For each well, a multi-stage hydraulic fracturing operation is performed. In Step 301, a fracture is created in one stage in a first well that is in contact with an oil-bearing subterranean formation in the first group of wells. The fracture emanating from this stage is also in contact with an oil-bearing subterranean formation, which can be the same as the oil-bearing subterranean formation being contacted with the fracture created in said one stage in the first well, or may be a different formation. Said one stage may be the first stage to be fractured in the first well. In one or more embodiments of the present invention, the stage that is fractured in step 301 may be any stage to be fractured but the last stage in the first well. In this embodiment, the first well is set to be the monitor well. It is noted that any well can be set as the monitor well. The fracturing operation may include sub-steps of drilling a well hole vertically or horizontally; inserting production casing into the borehole and then surrounding with cement; charging inside a perforating gun to blast small holes into the formation; and pumping a pressurized mixture of water, sand and chemicals into the well, such that the fluid generates numerous fractures in the formation that will free trapped oil to flow to the surface. It is noted that the fracturing operation can be carried out using any suitable conventional hydraulic fracturing methods, and is not limited to the above mentioned sub-steps.

In Step 302, the next stage in the first well, where the fracture has been created for one stage in Step 301, is isolated from said one stage with a completed fracturing operation. Isolating a stage from a subsequent stage as used in this disclosure is defined as severely restricting liquid transport between the stages such that mass transport between the stages does not exceed 0.1 kg/s. Said next stage may be the second stage to be fractured in the first well. In one or more embodiments of the present invention, the stage that is isolated in step 302 may be the last stage to be fractured. In one or more embodiments of the present invention, the stage that is isolated in step 302 may be any stage to be fractured but the first stage in the first well. The isolating method is, but not limited to, installing a bridge plug internally in the first well while swellable packers exist externally around the well between the stages. The bridge plug may be retrievable and set in compression and/or tension and installed in the first well between the aforementioned two stages. In one or more embodiments of the present invention, the bridge plug may also be non-retrievable and dilled out after the completions are finished. It is noted that other suitable isolation devices can also be used.

After the Step 302 of isolating the next stage from the stage with a completed fracturing operation, in Step 303, a fracture is created in said next stage. Again, the fracturing operation can be carried out using any suitable conventional hydraulic fracturing methods. The fracture emanating from this stage is in contact with an oil-bearing subterranean formation.

In one or more embodiments of the present invention, before the Step 303, other wells in the first group may be subjected to fracturing operations. The number of stages completed in the other wells may be equal to the number of stages completed in the monitor well before the Step 303. In one or more embodiments of the present invention, the number of stages completed in the monitor well may be at least one more than the number of stages completed in other wells before the Step 303.

After the fracture is created in said next stage, in Step 304, a pressure of the first well is measured by using a pressure gauge in direct fluid communication with said next stage in the first well. The pressure gauge may be, but is not limited to, a surface pressure gauge or a subsurface pressure gauge. Among suitable pressure measurement techniques, the surface gauge approach is far simpler and far less costly, reducing the risk of implementation and cost by orders of magnitude. Traditionally, the surface gauges have only been used for evaluating direct communication between wells. They have not been used for determining hydraulic fracture properties such as proximity, geometry, overlap, etc., because in the conventional approach, pressure is read from the entire well, including all the stages that have been perforated prior to that point. They also do not allow for a waiting period between the time the last stage was fractured in the monitor well and the time at which point pressure is read in that well for adjacent wells of interest. The method according to the present invention here is using the surface gauge to acquire pressure information associated with an isolated stage in the first well, instead of the entire well, and allowing for a resting period so that the location of the isolated stage can be better understand by detecting and interpreting smaller signals, which in turn enables calculation of the proximity and overlap of new fractures growing near the observation fractures.

In the meantime, in Step 305, a fracture is created in one or more stages in a well that is in contact with an oil-bearing subterranean formation in the second group of wells, where the well is an adjacent well of the monitor well so that the fracture in said well induces the pressure being measured in Step 304 to change. It is noted that the adjacent well is not limited to an immediately adjacent well or even a well in the same formation or stratigraphic layer, as long as the fracture in said well can induce the pressure being measured in Step 304 to change. During the Step 305, no fluid is injected into the first well from a wellhead thereof in order to ensure the measured pressure in Step 304 is associated with the isolated stage with smaller signals. The fracture emanating from the aforementioned one or more stages in the second group is in contact with an oil-bearing subterranean formation, which can be the same as the oil-bearing subterranean formation being contacted with the fracture created in the wells in the first group, or may be a different formation. After Step 305, oil may be produced from the first well in the first group and the aforementioned well in the second group.

In one or more embodiments of the present invention, before Step 305, other wells in the first group may be subjected to fracturing operations. The number of stages completed in a well, other than the first well, in the first group may be greater than or equal to the number of stages completed in the first well before Step 305.

Then, the pressure change is recorded in Step 306. By designing the sequence of stage timings as outlined above, while allowing for a waiting period between the time the last stage was fractured in the monitor well and the time at which point pressure is read in that well for adjacent wells of interest, the method according to the present invention avoids delaying operations in any way, thereby maintaining operational efficiency at its maximum by increasing data quality and data specificity all at once.

In one or more embodiments of the present invention, a duration of time between Step 303 and Step 305 is greater than three hours, preferably greater than twenty-four hours, which will allow pressure to decay sufficiently. In one or more embodiments, the duration of time between Step 303 and Step 305 may be greater than ninety-six hours. The method from Step 301 to Step 306 may be repeated two or more times, preferably five or more times on a single pad. With regard to the multi-stage fracturing operation performed for the wells in each group, there are various fracturing operation schemes that can be chosen from. In one or more embodiments of the present invention, a zipper-fracturing approach may be adopted. In particular, for each of a pair of adjacent wellbores that are parallel to each other, the fracturing stage placement sequence is alternated; a stage is fractured at the first well in a first group, followed by fracturing a stage at the second well in the first group. The stages being placed are opposite each other, just like the little teeth of a zipper. Alternatively, other types of fracturing approaches may be adopted, for example, a simultaneous-fracturing approach.

FIGS. 3(*a*)-3(*f*) are exemplary diagrams of the stage sequencing of a hydraulic fracturing operation for a multi-well pad according to the present invention.

FIG. 3(*a*) shows a first group of wells, Group I, and a second group of wells, Group II. The vertical lines 400 illustrate wells. Group I includes three wells, 1A, 2A and 3A, and Group II includes two wells, 1B and 2B. It is noted that the numbers of groups of wells and the types of wells in terms of the formation are not limited to those shown in FIGS. 3(*a*)-3(*f*). It is also noted that the wells in the Groups I and II are not limited to be in the same formation and they may be in different formations, respectively, such as Three Forks formation and Middle Bakken formation for instance. One of ordinary skill in the art will appreciate that the exemplary diagrams of the stage sequencing shown in FIGS. 3(*a*)-3(*f*) are provided for exemplary purposes only.

Turning to FIG. 3(*b*) illustrating performance of Step 301, the horizontal lines 500 intersecting the vertical lines 400 illustrate fractures created in the wells, and the numbers beside the horizontal lines 500 illustrate the sequencing of the stages in each well. Referring to FIG. 3(*b*), four stages have been completed in the well 1A, and three stages have been completed in each of the wells 2A and 3A. However, the number of stages completed in each well in Group I is not limited to the illustration in FIG. 3(*b*).

FIG. 3(*c*) illustrates performance of Step 302 to Step 303. Referring to FIG. 3(*c*), the middle well 1A in Group I is selected to be the monitor well, and a surface pressure measuring gauge is provided to the well 1A. In other embodiments of the present invention, any well can be selected to be the monitor well. After the fourth stage fracturing is completed, a bridge plug, represented by a star, is inserted between the fourth stage and the fifth stage, such that the fifth stage of the monitor well is isolated from the fourth stage whose fracturing operation has been completed, and then a fracture is created in the fifth stage. After the fifth stage fracturing is completed, the valve connecting the pressure gauge to the well is opened and the pressure gauge is in direct fluid communication with the fifth stage. At this time, the sixth stage has not yet been prepared by plugging and perforating. It is noted that plugging and perforating operation mentioned here may adopt any suitable conventional systems, such as the open-hole (OH) graduated ball-drop fracturing isolation system where the ball isolates the next stage from the previous stage. It is further noted that being indirect fluid communication mentioned above is defined as no impermeable barrier to liquid molecules existing between the fluid in contact with the pressure gauge and the fluid residing in the stage in the first well.

FIG. 3(*d*) illustrates performance of Step 304, where the pressure gauge remains open and is in direct fluid communication with the fifth stage, such that a pressure associated with the isolated fifth stage can be measured. It is noted that at this time, the sixth stage still has not yet been prepared by plugging and perforating. It is also noted that another four stages of fracturing operation have been performed to each of the well 2A and well 3A in Group I. The number of stage fracturing operations that are further completed in the wells, other than the monitor well 1A, in Group I is not limited to that shown in FIG. 3(*d*).

Turning to FIG. 3(*e*), which illustrates performance of Step 305, each of the wells 1B and 2B in Group II are subjected to six stages of fracturing operations. It is noted that the number of stages completed in the wells of Group II can be less than or more than the number of stages completed in the monitor well 1A. It is noted that at this time, the sixth stage still has not yet been prepared by plugging and perforating. Since the wells 1B and 2B in Group II are adjacent wells of the monitor well 1A in Group I, the fracturing operations performed in the wells 1B and 2B in Group II induces the pressure being measured by the pressure gauge to change. The pressure change is then recorded for further processing in order to determine optimal well spacing for further drilling operations. It is noted that in one or more embodiments of the present invention, a pressure change in the monitor well 1A in Group I induced by the fracturing operations performed in the wells 2A and 3A in the Group I is also recorded for further processing in order to determine optimal well spacing for further drilling operations.

Referring to FIG. 3(*f*), after the pressure reading is recorded, the pressure gauge is closed, and stage 6 is plugged and perforated for preparation of performing a fracturing operation. The Steps 301-306 may then be repeated for further stage fracturing operations.

After Step 306, the recorded pressure change in the monitor well is analyzed and processed to obtain information related to the geometry of the fracture, so as to evaluate the fluid communication between the monitor well in the first group and the adjacent wells in the second group. A computer algorithm which accounts for poromechanics may be used. The method of analyzing the data may include a number of methods involving computer simulations. In one or more embodiments of the present invention, typical commercial reservoir simulators can be used to evaluate the maximum fluid connectivity that could exist between wells and still not exceed the pressure signals observed. This can help one identify if there are pervasive connected natural fracture networks or to what extent the overall system allows for flow between an induced fracture in an adjacent well and the monitor well. In some other embodiments, hydraulic fracturing commercial simulators can be used in conjunction with the pressure data and inputs such as rate, pressure, injection duration and volume into the adjacent well to simulate hydraulic fracture growth and estimate the fracture geometry. In a preferred embodiment of the present invention, an advanced simulation tool, which coupled poromechanics with transport to capture the total induced pressure signal that could be seen in the observation fracture from the monitor well from a newly induced fracture in the adjacent well, is used. The above mentioned simulators for instance could use a coupled finite element-finite difference (FE-FD) scheme for more accurate analysis, and a parametric study could be undertaken to develop a contour plot to evaluate the geometry of hydraulic fractures more precisely by simply using the observed pressure response. With this type of method, both the overlap and the distance between fractures (spacing of fractures) can be determined with information obtained from the measured pressure changes in the monitor well. This also allows for less complex analytical analyses of the pressure data, which can shed light on whether communication responses were induced via poroelastic effects or whether they are caused from direct fluid communication.

In one or more embodiments of the present application, an instantaneous shut-in pressure (ISIP) is measured for the stage fractured in Step 301 and is then used in conjunction with the measured pressure change to evaluate the communication between the monitor well in the first group and the adjacent wells in the second group. More specifically, in one or more embodiments of the present invention, input parameters into the above mentioned analyses includes the measured pressure changes in the monitor well, and the ISIP of the next stage in the first well. The rate of change in the pressure response and the magnitude are clear indicators of either direct fluid communication or poroelastic influence. An example of direct fluid communication would be a dramatic rise in pressure (100's of psi)—often closely approaching or even exceeding the ISIP (typically within 10% of the ISIP would be a characteristic indicator) in a matter of minutes (less than 15 min) under standard hydraulic fracturing injection rates of being in excess of 30 barrels per minute into the adjacent well. But if the injection rate into the adjacent well is less than the abovementioned, direct fluid communication may still be observed with significant pressure increase but over longer periods of time. Basically the duration of time of the pressure rise from trough to peak can be estimated based on the injection rate into the adjacent well. Poromechanics signals on the other hand are typically less than a couple hundred psi and typically less than 10's psi. They have a more gradual rate of change as the fractures grow and overlap each other more and more inducing larger poromechanics responses, and they can yield continued pressure increases even after injection has stopped in the adjacent well as the fractures continue to propagate and as the pressure in the fractures equilibrates with time.

In one or more embodiments of the present invention, the analyzing and processing of the pressure change can be realized by digital electronic circuitry or hardware, including a programmable processor, a computer, a server, or multiple processors, computers or servers and their structural equivalents, or in combinations of one or more of them.

One of the key elements in the present invention is the concept of isolating a single stage in a monitor well that has been fractured using a bridge plug prior to that stage and using that well as a monitor well while stages in adjacent wells before and after that stage are hydraulically fractured. One of the reasons this has not been done before is that maintaining efficiency is absolutely critical in hydraulic fracturing operations. The present invention allows for providing an intrinsic waiting period by isolating an exact location in the monitor well to better understand the location by receiving signals from a surface pressure gauge that is in direct fluid communication with the isolated location, while maintaining efficiency of operations, not costing any additional time for operations. The method of the present invention collects more useful data by isolating communication with a single stage in the monitor well than along the whole monitor wellbore, so as to obtain a better mapping of hydraulic fracture proximity and overlap of new fractures growing near the monitor fractures than would be achieved in a case where all stages are in communication with the surface pressure gauge. The present invention further uses poromechanics and the analytical observation techniques coupled with the aforementioned designed sequence of the hydraulic fracturing jobs, which enables an accurate evaluation of fracture communication, well to well communication, hydraulic fracture proximity and overlap, and thereby obtain an optimal well spacing for future drilling operations.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A well system, comprising:

a first hydraulic fracture formed in a stage of a first well in a first group of wells of a multi-well pad;

a second hydraulic fracture formed in a next stage of the first well in the first group of wells of the multi-well pad;

an isolation device positioned in the first well between the stage of the first well and the next stage of the first well;

a hydraulic fracture formed in one or more stages in a well in a second group of wells of the multi-well pad;

a pressure gauge positioned in the first well in the first group of wells and in direct fluid communication with the next stage in the first well, the pressure gauge configured to measure a pressure change in the next stage induced by formation of the hydraulic fracture in the one or more stages in the well in the second group of wells while the next stage of the first well is isolated from the stage of the first well; and a pressure measurement recorder configured to communicably couple to the pressure gauge to record the measured pressure change in the next stage in the first well.

2. The well system of claim 1, further comprising a wellhead that is in direct fluid communication with the hydraulic fracture in the one or more stages in the well in the second group of wells, wherein no fluid is injected into the first well from the wellhead during formation of the hydraulic fracture in the one or more stages in the well in the second group of wells.

3. The well system of claim 1, wherein the pressure gauge is configured to measure the pressure change at a duration of time greater than three hours subsequent to formation of the second fracture in the first well.

4. The well system of claim 1, wherein the pressure gauge is configured to measure the pressure change at a duration of time greater than twenty-four hours subsequent to formation of the second fracture in the first well.

5. The well system of claim 1, wherein the first group of wells comprises two or more wells.

6. The well system of claim 1, wherein the first group of wells comprises three or more wells, and no well in the first group of wells is common with the second group of wells.

7. The well system of claim 6, wherein at a particular time of completion of the well system which is prior to formation of the second hydraulic fracture, the first well includes a first number of completed stages that is at least one more than a second number of completed stages in any other well in the first group of wells.

8. The well system of claim 6, wherein at a particular time of completion of the well system which is prior to formation of the hydraulic fracture in the one or more stages in the well in the second group of wells, a well in the first group of wells, other than the first well, includes a first number of completed stages that is greater than or equal to a second number of completed stages in the first well.

9. The well system of claim 1, further comprising:

a third hydraulic fracture formed in another stage of the first well, the isolation device positioned between the next stage of the first well and the another stage of the first well; and another hydraulic fracture formed in the one or more stages in the well in the second group of wells, wherein the pressure gauge is positioned in the first well in the first group of wells and in direct fluid communication with the another stage in the first well, the pressure gauge configured to measure another pressure change in the another stage induced by formation of the another hydraulic fracture in the one or more stages in the well in the second group of wells while the another stage of the first well is isolated from the next stage of the first well, and the pressure measurement recorder is configured to communicably couple to the pressure gauge to record the measured another pressure change in the another stage in the first well.

10. The well system of claim 1, wherein said stage in the first well is any stage but the last stage in the first well.

11. The well system of claim 1, wherein the isolation device comprises a bridge plug internally positioned in the first well between the stage and the next stage.

12. The well system of claim 11, further comprising a swellable packer positioned externally outside the first well between the stage and the next stage.

13. The well system of claim 1, wherein said next stage in the first well is any stage after the first stage in the first well.

14. The well system of claim 1, wherein the pressure gauge comprises a surface pressure gauge.

15. The well system of claim 1, wherein wells in the first group of the wells are zipper-fractured.

16. A well system, comprising:

a first hydraulic fracture formed in a stage of a first well in a first group of wells of a multi-well pad;

a second hydraulic fracture formed in a next stage of the first well in the first group of wells of the multi-well pad;

an isolation device positioned between the stage of the first well and the next stage of the first well;

a hydraulic fracture formed in one or more stages in a well in a second group of wells of the multi-well pad;

a pressure gauge positioned in the first well in the first group of wells and in direct fluid communication with the next stage in the first well, the pressure gauge configured to measure a pressure change in the next stage induced by formation of the hydraulic fracture in the one or more stages in the well in the second group of wells while the next stage of the first well is isolated from the stage of the first well;

a pressure measurement recorder configured to communicably couple to the pressure gauge to record the measured pressure change in the next stage in the first well a computing system configured to communicably couple to at least one of the pressure measurement recorder or the pressure gauge and perform operations comprising:

processing the measured pressure change to obtain information related to the geometry of the fractures emanating from the next stage in the first well in the first group of wells and any stages in the well in the second group of wells; and evaluating fluid communication between the first well in the first group of wells and the well in the second group of wells using the obtained information.

17. The well system of claim 16, wherein the processing of the measured change to obtain information related to the geometry of the fractures emanating from the next stage in the first well in the first group of wells and any stages in the well in the second group of wells accounts for poromechanics.

18. The well system of claim 16, wherein the computing system is configured to perform further operations comprising:

processing an instantaneous shut-in pressure (ISIP) of the next stage in the first well in conjunction with the measured pressure change to evaluate the fluid communication.

* * * * *